US006201197B1

(12) United States Patent
Mori et al.

(10) Patent No.: US 6,201,197 B1
(45) Date of Patent: Mar. 13, 2001

(54) SWITCH DEVICE WITH AC INLET

(75) Inventors: Toshiharu Mori; Masayuki Takeda; Yoshimi Goto, all of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/621,474

(22) Filed: Jul. 21, 2000

(30) Foreign Application Priority Data

Jul. 26, 1999 (JP) ..... 11-210534

(51) Int. Cl.[7] ..... H01H 9/00

(52) U.S. Cl. ..... 200/51 R; 200/51.11; 439/740

(58) Field of Search ..... 200/51 R, 51.02, 200/51.05–51.09, 51.1–51.13; 439/76.1, 76.2, 740, 949

(56) References Cited

U.S. PATENT DOCUMENTS 3,723,679 * 3/1973 Carney ..... 200/50 B
4,054,762 * 10/1977 Knecht ..... 200/50 B
4,256,935 * 3/1981 Ito et al. ..... 200/51 R
5,659,209 * 8/1997 Huen ..... 307/125

FOREIGN PATENT DOCUMENTS 08007559 12/1996 (JP) ..... G11B/33/12

* cited by examiner

*Primary Examiner*—Michael Friedhofer
(74) *Attorney, Agent, or Firm*—Brinks Hofer Gilson & Lione

(57) ABSTRACT

A connecting structure in a switch device with AC inlets is disclosed wherein, when terminals of the switch device are connected together using a thin metallic connecting strip, there is no fear of an external force being imposed on the terminals and causing damage to the connection between the terminals and the connecting strip, nor is there any fear of unstable contact, and which can keep a terminal holding position of the bracket stable and is superior in assemblability and reliability of connection. The switch device comprises AC inlets having a connecting pin for AC input and an inlet terminal for connection, an AC switch having a connecting-side terminal and an output-side terminal, a metallic connecting strip for electrically connecting the inlet terminal of the AC inlets and the connecting-side terminal of the AC switch with each other, and a bracket with the AC inlets and the AC switch attached thereto. The inlet terminal, which is connected with the connecting strip, is provided with a connecting piece for connection with the connecting strip and an arm portion having the connecting piece at a free end thereof, the free end of the arm portion being flexible in a rotational direction centered on the axis of the connecting pin of the AC inlets.

5 Claims, 5 Drawing Sheets

SWITCH DEVICE WITH AC INLET

BACKGROUND OF THE INVENTION

1. Field of the Invention

The present invention relates to a switch device having an AC inlet and an AC switch which are accommodated within a common bracket. Particularly, the invention is concerned with a connecting structure for connecting terminals electrically with each other.

2. Description of the Prior Art

In conventional switch devices in which an AC inlet and an AC switch are accommodated within a common bracket, there is generally known a switch device in which a common bracket formed of an insulating material such as a synthetic resin is provided with receptacle portions, and an AC inlet and an AC switch are fitted in those receptacle portions respectively, and a switch device in which a bracket is allowed to also serve as an insulating base of an AC inlet, and an AC switch is attached thereto.

As methods for connecting the AC inlet and the AC switch in such switch device equipped with AC inlet there is known a method in which lead wires or the like are soldered to the respective terminals and a method in which both are connected together using a printed circuit board with a connecting pattern printed thereon. In both methods, however, for ensuring the distance of an energized portion defined by the electric appliance and material control law and also by safety standards in various countries, an external size of the bracket increases in the thickness direction, thus making it difficult to follow the tendency to the reduction of thickness. Moreover, in case of using a printed circuit board, an increase of cost results.

As a method proposed recently for the connection of AC inlet and AC switch there is known a method in which a connecting strip serving as a conductive portion is formed using a thin metallic strip such as a thin steel or brass strip and terminals are connected together through the said connecting strip. According to this method using such a connecting strip, it becomes possible to thin the terminals to be connected and the assembly is easy, so that the reduction of cost can be attained.

In the above structure of the conventional switch device with AC inlet, however, in the case of connecting the terminal of the AC inlet and that of the AC switch with each other by using the connecting strip, since the connection with the connecting strip is a solid connection made by caulking or soldering, the connection is deficient in flexibility. Particularly, since an attachment plug for the supply of an alternating current from an external power supply is inserted and pulled out with respect to the terminal of the AC inlet, an external force is exerted on the terminal, giving rise to the problem that the connection between the terminal and the connecting strip is damaged or that an unstable contact results.

Further, the AC inlet terminal may come off the terminal held position due to damage of the connection between the terminal and the connecting strip or the terminal holding position of the bracket may undergo a thermal deformation, with consequent wobbling of the terminal and hence unstable holding for the connecting strip. Thus, a problem has been encountered in the assemblability and reliability of the connection.

SUMMARY OF THE INVENTION

Accordingly, it is an object of the present invention to solve the above-mentioned problems and provide a connecting structure in a switch device with AC inlet wherein, when terminals of the switch device are connected together using a thin metallic connecting strip, there is no possibility of an external force being imposed on the terminals and causing damage to the connection between the terminals and the connecting strip, nor is there any possibility of unstable contact, and which can keep the terminal holding position of the bracket stable and is superior in assemblability and reliability of connection.

For solving the above-mentioned problems, in the first aspect of the present invention there is provided a switch device comprising an AC inlet having a connecting pin for AC input and an inlet terminal for connection, an AC switch having a connecting-side terminal and an output-side terminal, a metallic connecting strip for electrically connecting the inlet terminal of the AC inlet and the connecting-side terminal of the AC switch with each other, and a bracket with the AC inlet and AC switch attached thereto, wherein the inlet terminal connected with the connecting strip is provided with a connecting piece for connection with the connecting strip and an arm portion having the connecting piece at a free end thereof, the free end of the arm portion being flexible in a rotational direction centered on the axis of the connecting pin of the AC inlet.

In the second aspect of the present invention, the arm portion is formed integrally with the inlet terminal using the same metallic material.

In the third aspect of the present invention, the arm portion is extended at one end of the connecting pin in a direction orthogonal to the axis of the connecting pin and is brought into abutment against a lower surface of the bracket to prevent the connecting pin from coming off in its projecting direction.

In the fourth aspect of the present invention, the inlet terminal is inserted and mounted into a holding position established in the bracket, and the connecting piece for connection with the connecting strip is positioned offset relative to the holding position which is a mounting position of the inlet terminal for the bracket.

In the fifth aspect of the present invention, a slot is formed in the lower surface of the bracket and the arm portion is positioned in the slot so as to be movable within the range of the slot.

DETAILED DESCRIPTION OF A PREFERRED EMBODIMENT

Figure 1:
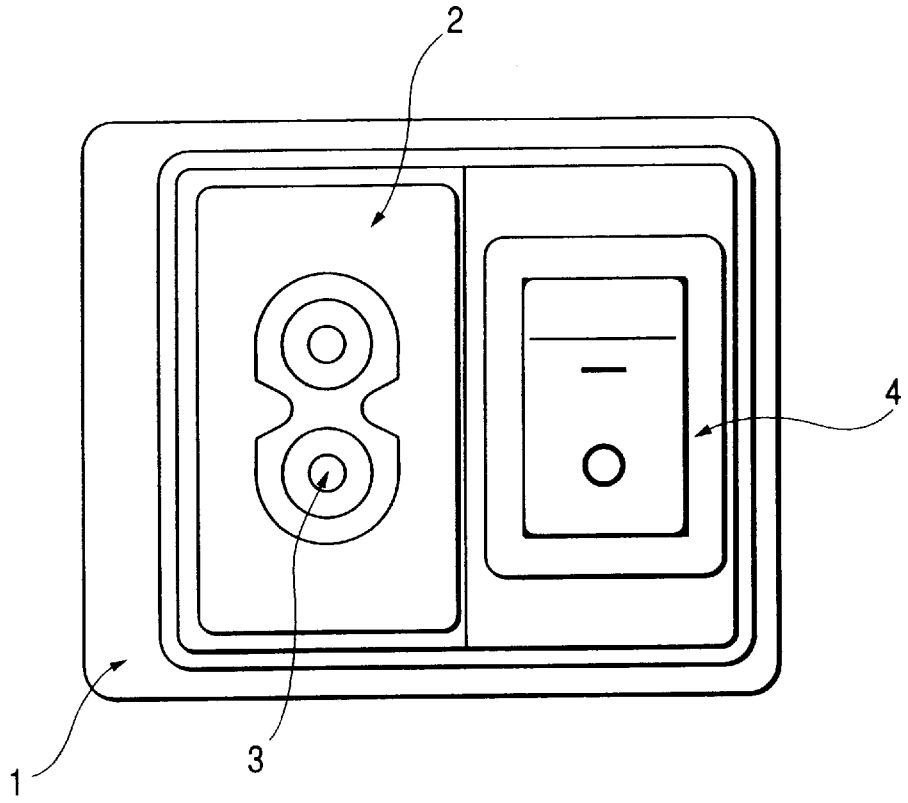
FIG. 1 is a plan view of a switch device with AC inlet according to an embodiment of the present invention.
Figure 2:
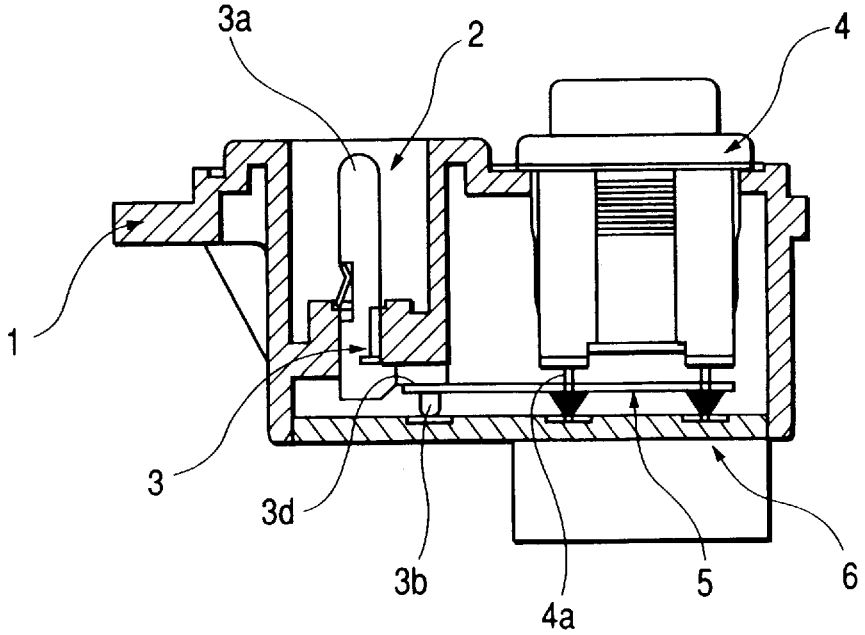
FIG. 2 is a vertical sectional view of the switch device of FIG. 1.
Figure 3:
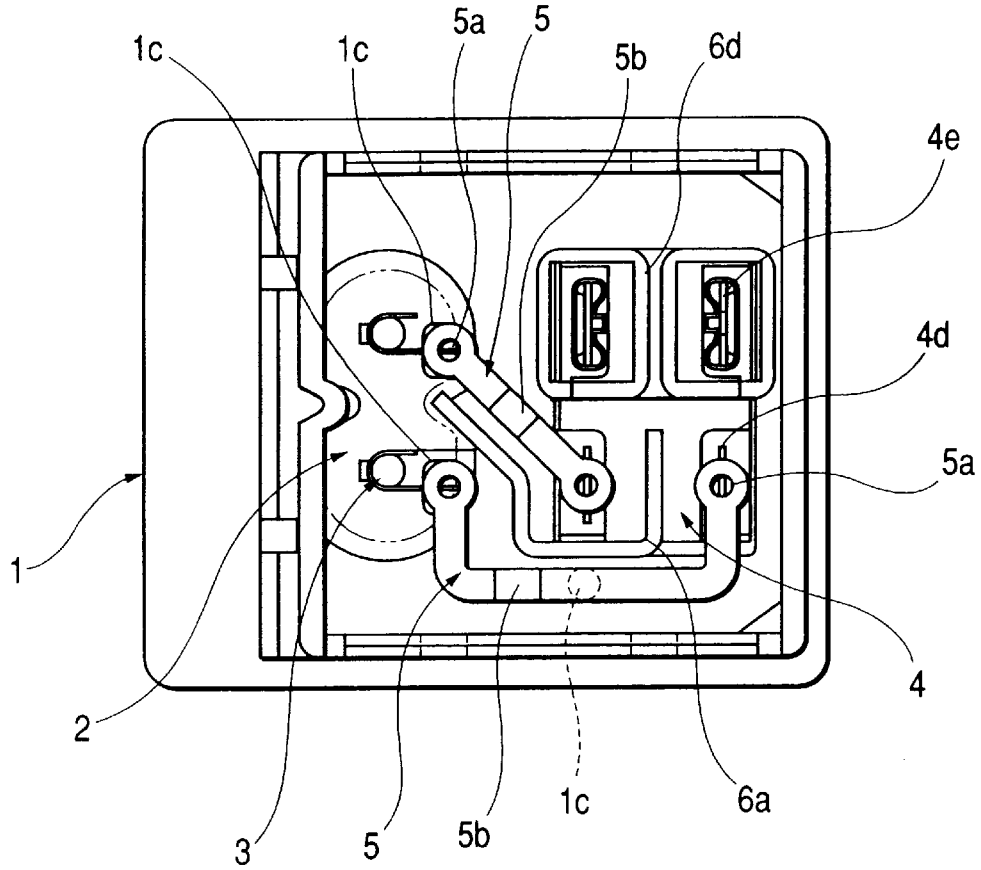
FIG. 3 is an explanatory diagram showing a connected state of connecting strips according to the invention.
Figure 4:
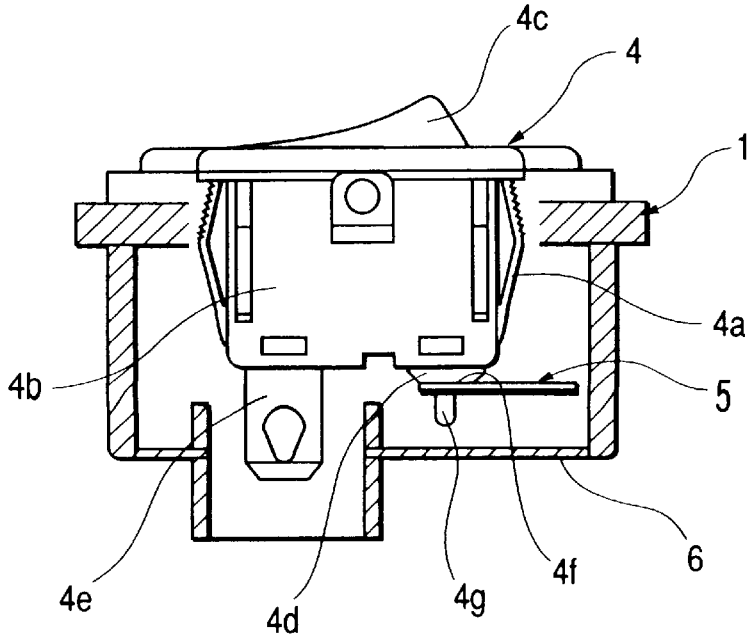
FIG. 4 is a sectional view showing a mounting portion for mounting an AC switch according to the invention.
Figure 5:
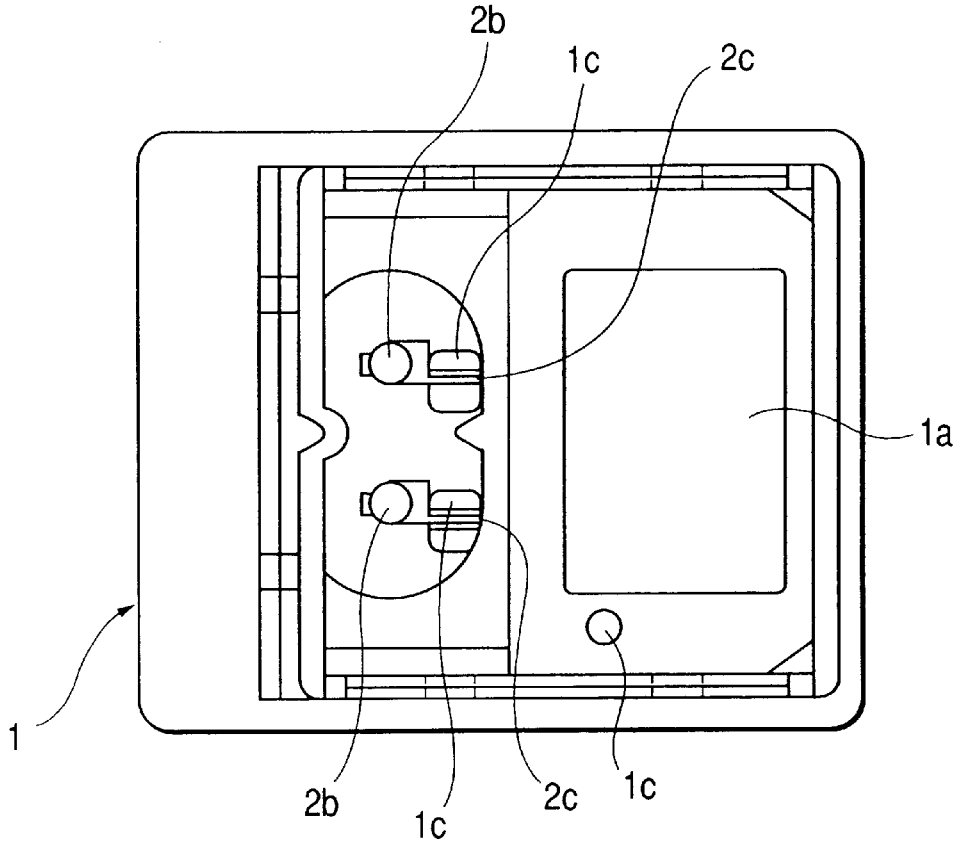
FIG. 5 is a bottom view of a bracket according to the invention.
Figure 6:
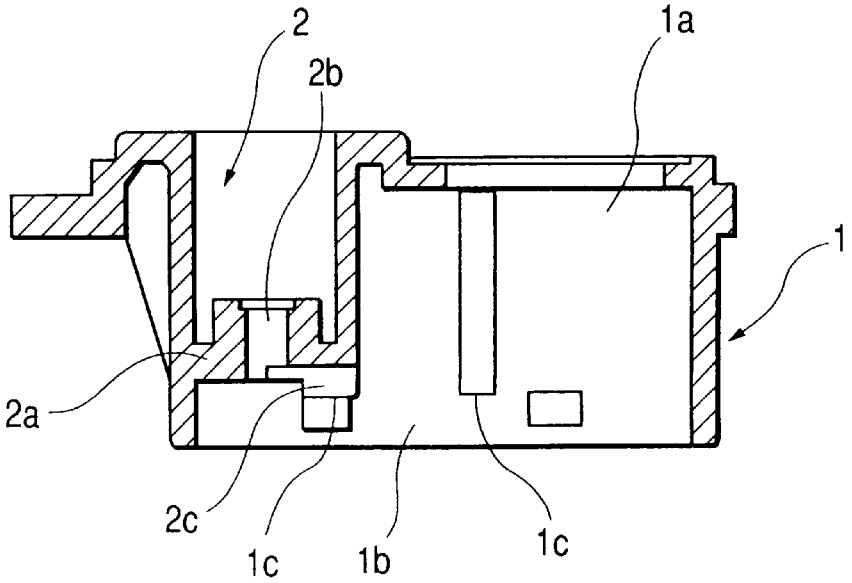
FIG. 6 is a vertical sectional view of the bracket of FIG. 5.
Figure 7:
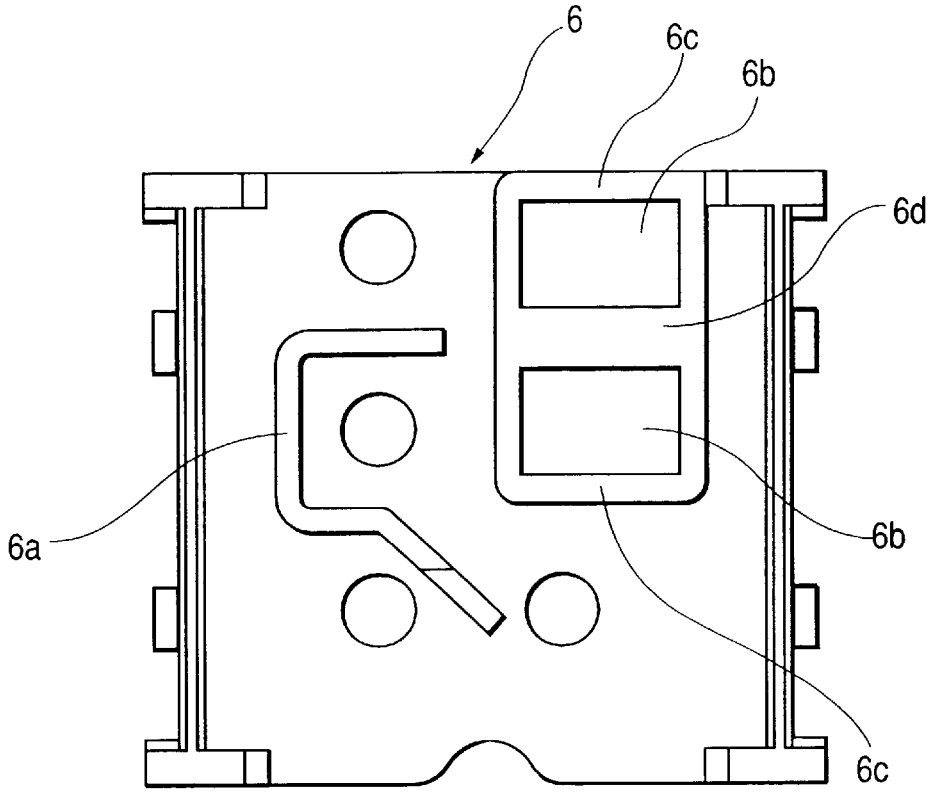
FIG. 7 is a plan view of an insulating cover according to the invention.
Figure 8:
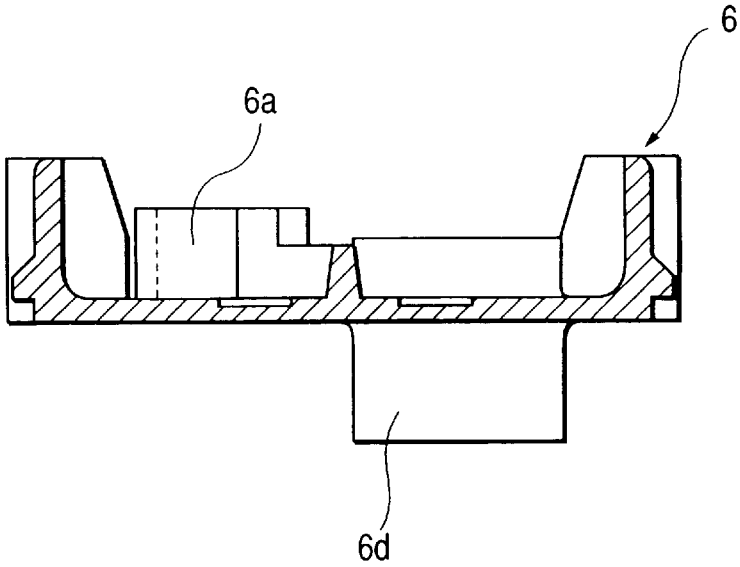
FIG. 8 is a vertical sectional view of the insulating cover of FIG. 7.
Figure 9:
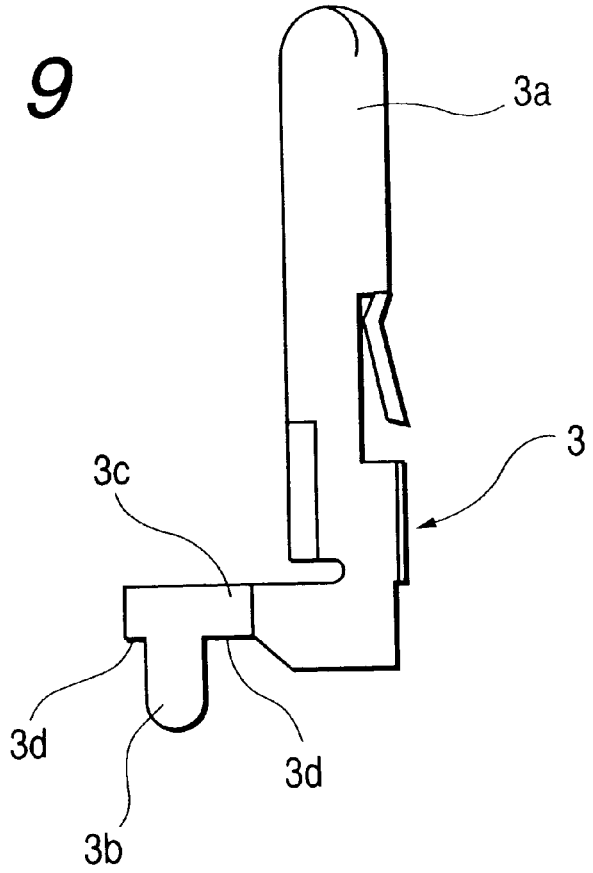
FIG. 9 is a front view of an inlet terminal according to the invention.
Figure 10:
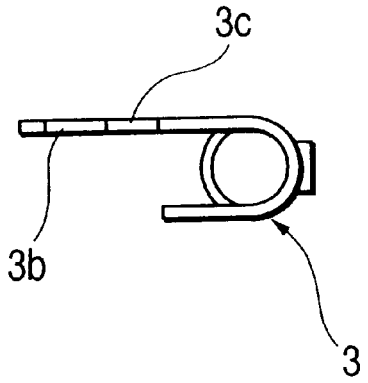
FIG. 10 is a bottom view of the inlet terminal of FIG. 9.

An embodiment of the present invention will be described in detail hereunder with reference to FIGS. 1 to 10, of which FIG. 1 is a plan view of a switch device with AC inlet embodying the present invention, FIG. 2 is a vertical sectional view thereof, FIG. 3 is an explanatory diagram showing a connected state of connecting strips, FIG. 4 is a sectional view showing a mounting portion for an AC switch, FIG. 5 is a bottom view of a bracket, FIG. 6 is a vertical sectional view thereof, FIG. 7 is a plan view of an insulating cover, FIG. 8 is a vertical sectional view thereof, FIG. 9 is a front view of an inlet terminal, and FIG. 10 is a bottom view thereof.

In these figures, a bracket 1 is formed in a generally box shape using an insulating material such as a synthetic resin. On the left-hand side of the bracket 1 in the figures is integrally formed an insulating base 2 of an AC inlet into which is inserted an attachment plug (not shown) for the supply of an alternating current from an external power supply. The insulating base 2 is formed in a box shape having a bottom portion 2*a* whose upper side is open. In the bottom portion 2*a* are formed a pair of through holes 2*b*. An inlet terminal 3 formed of an electrically conductive metallic material such as brass and having a connecting pin 3*a* whose tip end is formed in a rod shape, is fixed into each through hole 2*b* by a suitable method such as press-fitting.

On the opposite end side of the connecting pin 3*a* in the inlet terminal 3 is formed a connecting piece 3*b* for connection with a connecting strip to be described later, the connecting piece 3*b* being extended outside of the bottom portion 2*a*. The connecting piece 3*b* is positioned so as to be offset relative to the position of each through hole 2*b* which position is the mounting position of the inlet terminal 3. By so doing, the through hole 2*b* in the bracket 1 located in the mounting position of the inlet terminal 3 is prevented from being deformed by heat generated at the time of soldering the connecting piece 3*b* and a connecting strip with each other.

The inlet terminal 3 is formed with an arm portion 3*c* extended in the shape of a strip from a base portion of the inlet terminal and having a flexible distal end. At the distal end of the arm portion 3*c* is formed a position restricting stepped portion 3*d*, with the connecting piece 3*b* as an upright piece being formed on the stepped portion 3*d*. At one end of the connecting pin 3*a* the arm portion 3*c* extends in a direction orthogonal to the axis of the connecting pin. The arm portion 3*c* is brought into abutment against a lower side of the bottom 2*a* of the bracket 1 to prevent the connecting pin 3*a* from coming off in its projecting direction.

In the lower surface of the bottom portion 2*a* is formed a slot 2*c* contiguously to each through hole 2*b*. An inner width of the slot 2*c* is set somewhat wide so that the arm portion 3*c* is movable within the range of the slot 2*c*. When the inlet terminal 3 is inserted into the through hole 2*b*, the arm portion 3*c* is restricted in its position by the slot 2*c*, whereby it becomes easy to effect the mounting. After the mounting, a free end of the arm portion moves within the range of the slot 2*c* and therefore any excessive external force is exerted on the connection with the connecting strip to be described later, that is, it is possible to prevent damage of the connection.

The inlet terminal 3 is integrally formed into a generally L shape by cutting or bending with use of an electrically conductive metallic material. The connecting pin 3*a* is formed in a rod shape of a round section and is press-fitted into a connecting terminal (not shown) of an attachment plug such as a cord for the supply of electric power from an external power supply.

On the right-hand side of the bracket 1 in the figures is formed an AC switch receptacle portion 1*a* in an opposed relation to the insulating base 2 of the AC inlet, the AC switch receptacle portion 1*a* being open to an upper surface of the bracket 1. Within the AC switch receptacle portion 1*a* is mounted an AC switch 4 of a seesaw type. The AC switch 4 is mounted to the bracket 1 by snap-in fitting through a pair of mounting pieces 4*a* formed respectively on both sides of the AC switch 4.

The AC switch 4 is an existing seesaw type power switch and is formed in a box shape using an insulating material such as a synthetic resin. The AC switch 4 is made up of a case 4*b* having the mounting pieces 4*a* on both sides thereof, an operating knob 4*c* disposed on an upper surface of the case 4*b* and adapted to be operated in a seesaw fashion, a movable contact (not shown) received within the case 4*b* and operated by the operating knob 4*c*, a fixed contact (not shown) adapted for contact with and separation from the movable contact, connecting-side terminals 4*d* drawn out from the fixed contact, and output-side terminals 4*e*.

Each connecting-side terminal 4*d* projects downward from a lower surface of the case 4*b* and a position restricting stepped portion 4*f* is formed halfway. Further, a connecting piece 4*g* whose distal end is thinner than its base portion is formed from the position restricting stepped portion 4*f*. Each output-side terminal 4*e* is formed by a Faston terminal so as to permit Faston connection to an external electronic device (not shown).

On a lower surface side of the bracket 1 is formed an opening 1*b*, in which are disposed the inlet terminals 3 extended from the insulating base 2 of the AC inlet and are also disposed the connecting-side terminals 4*d* of the AC switch 4. A plurality of connecting strips 5 each formed by an electrically conductive metallic strip such as steel or brass strip are connected between the inlet terminals 3 and the connecting side terminals 4*d*. Connecting holes 5*a* formed in the connecting strips 5 and the connecting pieces 4*g* of the connecting-side terminals 4*d* are connected with each other, whereby the inlet terminals 3 and the AC switch 4 are connected together electrically.

In this case, since the inlet terminals 3 are respectively provided with the position restricting stepped portions 3*d* and the connecting-side terminals 4*d* of the AC switch 4 are also respectively provided with the position restricting stepped portions 4*f*, the connecting strips 5 are restricted their positions by the position restricting stepped portions 3*d* and 4*f* and can thereby be installed so as to be generally parallel to the plane of the opening 1*b* of the bracket 1, i.e., the plane of an insulating cover to be described later. Thus, the connecting strips 5 can be installed stably and it is possible to ensure the reliability of connection.

Moreover, within the opening 1*b* of the bracket 1 are integrally provided a pair of holding portions 1*c* for holding the connecting strips 5 respectively, and when the connecting strips 5 are installed for connection with the connecting pieces 3*b* of the connecting terminals 3 and also for connection with the connecting pieces 4*g* of the connecting-side terminals 4*d* of the AC switch, the holding portions 1*c* come into abutment against lower surfaces of the connecting strips 5, so that the connecting strips are held firmly and the mounting stability and the reliability of connection are improved.

The inlet terminals 3 are each provided with the flexible strip-like arm portion 3*c* and the presence of the arm portion 3*c* can afford flexibility in the connection between each connecting strip 5 and each inlet terminal 3, so, for example, even in the event the connecting pin 3*a* is wrenched when an attachment plug for the supply of an alternating current from an external power supply (not shown) is inserted, the arm portion 3*c* can bend following the wrenched motion, whereby each inlet terminal 3 can be prevented from being damaged.

An insulating cover 6 formed in a lid shape using an insulating material such as a synthetic resin is attached to the opening 1*b* of the bracket 1 so as to cover the connecting strips 5. The insulating cover 6 is integrally formed with a long projecting wall 6*a* for insulation which projects to the opening 1*b* side of the bracket 1. The projecting wall 6*a* is formed so as to be positioned between the connecting strips 5 when the insulating cover 6 is attached to the opening 1*b* of the bracket 1.

Since the projecting wall 6*a* for insulation is formed on the insulating cover 6, it is possible to prevent the occurrence of such problems as short-circuiting of the connecting strips 5 with each other and insulation degradation which are caused by external vibrations and shocks or the deposition of dust.

The insulating cover 6 is formed with an output-side terminal receptacle portion 6*d* comprising a pair of windows 6*b* and a wall portion 6*c* which surrounds the windows 6*b*. The output-side terminal receptacle portion 6*d* is formed so as to be positioned on the lower surface side of the AC switch receptacle portion 1*a* in the bracket 1. In the output-side terminal receptacle portion 6*d* are disposed the output-side terminals 4*e*. In this embodiment, the output-side terminals 4*e* are formed by Faston terminals, whereby the connection to external electronic devices (not shown) can be done easily.

Further, since the output-side terminal receptacle portion 6*d* defined by the wall portion 6*c* is formed in the insulating cover 6, a connecting pin (not shown) of the wire harness to be connected is guided by the wall portion 6*c*, whereby the output-side terminals (Faston terminals) 4 of the AC switch 4 are prevented from wobbling.

Although in the above embodiment the insulating base 2 of the AC inlet is integral with the bracket 1, the present invention is not limited thereto, but the insulating base 2 may be formed as a separate member like the AC switch 4. Also in this case there can be obtained the same effects as in the above embodiment.

Also as to the case 4*b* of the AC switch 4, it may be formed integrally with the bracket 1.

In the switch device with AC inlet according to the present invention, as set forth above, the inlet terminal connected with the connecting strip is provided with a connecting piece for connection with the connecting strip and is also provided with an arm portion having the connecting piece at a free end thereof, the free end of the arm portion being flexible in a rotational direction centered on the axis of the connecting pin. Therefore, flexibility can be imparted to the connection between the connecting strip 5 and the input terminal, so that even in the event the connecting pin is wrenched when an attachment plug is inserted, the arm portion can deflect following the motion of the connecting pin, whereby the inlet terminal can be prevented from being damaged.

Besides, since the arm portion is formed integrally with the inlet terminal using the same metallic material, not only it is possible to reduce the number of connections and of portions damaged by an external force, but also the assembling work becomes easier.

Moreover, since the arm portion extends in a direction orthogonal to the axis of the connecting pin at one end of the connecting pin and is brought into abutment against the lower surface of the bracket to prevent the connecting pin from coming off in its projecting direction, such a simple anti-dislodgment structure will do.

Further, since the inlet terminal is inserted and mounted into the holding position established on the bracket side and the connecting piece for connection with the connecting strip is positioned offset relative to the holding position in which the inlet terminal is mounted to the bracket, it is possible to prevent the inlet terminal holding position from being deformed or deteriorated with the heat induced by soldering.

Additionally, since a slot is formed in the lower surface of the bracket and the arm portion is positioned within the slot so as to be movable within the range of the slot, the arm portion is restricted its position by the slot when the inlet terminal is inserted into the slot and therefore the assembling work becomes easier. After the assembly, the free end of the arm portion is movable within the range of the slot, so that an excessive external force is not exerted on the connection with the connecting strip and hence it is possible to prevent the occurrence of damage.

What is claimed is:

1. A switch device comprising:

an AC inlet having a connecting pin for AC inlet and an inlet terminal for connection;

an AC switch having a connecting-side terminal and an output-side terminal;

a metallic connecting strip for electrically connecting the inlet terminal of the AC inlet and the connecting-side terminal of the AC switch with each other; and a bracket with the AC inlet and the AC switch attached thereto, wherein the inlet terminal connected with the connecting strip is provided with a connecting piece for connection with the connecting strip and an arm portion having the connecting piece at a free end thereof, the free end of the arm portion being flexible in a rotational direction centered on an axis of the connecting pin of the AC inlet.

2. A switch device according to claim 1, wherein the arm portion is formed integrally with the inlet terminal using the same metallic material.

3. A switch device according to claim 1, wherein the arm portion extends in a direction orthogonal to the axis of the connecting pin at one end of the connecting pin and is brought into abutment against a lower surface of the bracket to prevent the connecting pin from coming off in a projecting direction.

4. A switch device according to claim 1, wherein the inlet terminal is inserted and mounted into a holding position established in the bracket, and the connecting piece for connection with the connecting strip is positioned offset relative to the holding position which is a mounting position of the inlet terminal for the bracket.

5. A switch device according to claim 1, wherein a slot is formed in a lower surface of the bracket and the arm portion is positioned in the slot so as to be movable within the range of the slot.

* * * * *